US008660230B2

(12) United States Patent
Singh et al.

(10) Patent No.: US 8,660,230 B2
(45) Date of Patent: Feb. 25, 2014

(54) SYSTEM AND METHOD FOR THE VENTILATED STORAGE OF HIGH LEVEL RADIOACTIVE WASTE IN A CLUSTERED ARRANGEMENT

(75) Inventors: Krishna P. Singh, Jupiter, FL (US); Stephen J. Agace, Marlton, NJ (US)

(73) Assignee: Holtec International, Inc.

( * ) Notice: Subject to any disclaimer, the term of this patent is extended or adjusted under 35 U.S.C. 154(b) by 445 days.

(21) Appl. No.: 12/340,948

(22) Filed: Dec. 22, 2008

(65) Prior Publication Data

US 2009/0159550 A1 Jun. 25, 2009

Related U.S. Application Data

(60) Provisional application No. 61/016,446, filed on Dec. 22, 2007.

(51) Int. Cl.
*G21C 19/00* (2006.01)
*G21C 19/32* (2006.01)

(52) U.S. Cl.
USPC ..... 376/272; 250/506.1; 250/507.1

(58) Field of Classification Search
USPC ..... 376/272; 250/207.1; 588/16
See application file for complete search history.

(56) References Cited

U.S. PATENT DOCUMENTS 3,111,078 A 11/1963 Breckenridge
3,111,586 A * 11/1963 Rogers ..... 250/507.1
3,629,062 A 12/1971 Muenchow
3,739,451 A 6/1973 Jacobson
3,745,707 A 7/1973 Herr
3,765,079 A 8/1973 Wesinstein
3,765,549 A * 10/1973 Jones ..... 414/290
3,800,973 A 4/1974 Weaver
3,836,267 A 9/1974 Schatz
3,910,006 A 10/1975 James (Continued)

FOREIGN PATENT DOCUMENTS

DE 3515871 11/1966
DE 2821780 11/1979

(Continued)

OTHER PUBLICATIONS

Computerized translation into English of Tani, Yutaro, JP-11202094-A, obtained from the Japan Patent Office, though Website (http://dossier1.ipdl.inpit.go.jp/AIPN/odse_top_dn.ipdl?N0000=7400). (on-line machine translation).*

*Primary Examiner* — Jack W Keith
*Assistant Examiner* — Sean P Burke
(74) *Attorney, Agent, or Firm* — The Belles Group, P.C.

(57) ABSTRACT

A system for receiving and storing high level radioactive waste comprising: an enclosure comprising walls having inlet ventilation ducts, a roof comprising an array of holes, and a floor; an array of metal shells located in an internal space of the enclosure, the array of metal shells being co-axial with the array of holes in the roof so that containers holding high level radioactive waste can be lowered through the array of holes in the roof and into the array of metal shells; the array of metal shells acting as load bearing columns for the roof; and each of the metal shells comprising (i) an expansion joint for accommodating thermal expansion and/or contraction of the metal shells; and (ii) one or more holes at a bottom portion of the metal shell.

22 Claims, 13 Drawing Sheets

(56) References Cited

U.S. PATENT DOCUMENTS

| | | | | | |
|---|---|---|---|---|---|
| 3,917,953 | A | * | 11/1975 | Wodrich | 250/506.1 |
| 3,935,062 | A | * | 1/1976 | Keller et al. | 376/264 |
| 3,945,509 | A | * | 3/1976 | Weems | 414/290 |
| 3,962,587 | A | * | 6/1976 | Dufrane et al. | 250/506.1 |
| 3,984,942 | A | | 10/1976 | Schroth | |
| 4,055,508 | A | * | 10/1977 | Yoli et al. | 376/272 |
| 4,078,968 | A | | 3/1978 | Golden et al. | |
| 4,158,599 | A | | 6/1979 | Andrews et al. | |
| 4,278,892 | A | * | 7/1981 | Baatz et al. | 250/506.1 |
| 4,288,698 | A | | 9/1981 | Baatz et al. | |
| 4,336,460 | A | | 6/1982 | Best et al. | |
| 4,355,000 | A | * | 10/1982 | Lumelleau | 376/205 |
| 4,356,146 | A | * | 10/1982 | Knappe et al. | 376/272 |
| 4,366,095 | A | * | 12/1982 | Takats et al. | 588/16 |
| 4,394,022 | A | | 7/1983 | Gilmore | |
| 4,410,802 | A | * | 10/1983 | Szulinski | 250/515.1 |
| 4,450,134 | A | * | 5/1984 | Soot et al. | 376/262 |
| 4,498,011 | A | * | 2/1985 | Dyck et al. | 250/507.1 |
| 4,525,324 | A | * | 6/1985 | Spilker et al. | 376/272 |
| 4,526,344 | A | | 7/1985 | Oswald et al. | |
| 4,527,066 | A | * | 7/1985 | Dyck et al. | 250/507.1 |
| 4,532,428 | A | * | 7/1985 | Dyck et al. | 250/507.1 |
| 4,585,611 | A | * | 4/1986 | Perl | 376/260 |
| 4,634,875 | A | * | 1/1987 | Kugeler et al. | 250/506.1 |
| 4,635,477 | A | | 1/1987 | Simon | |
| 4,649,018 | A | * | 3/1987 | Waltersdorf et al. | 376/272 |
| 4,663,533 | A | * | 5/1987 | Kok et al. | 250/506.1 |
| 4,671,326 | A | | 6/1987 | Wilhelm | |
| 4,690,795 | A | | 9/1987 | Hardin et al. | |
| 4,764,333 | A | * | 8/1988 | Minshall et al. | 376/203 |
| 4,780,269 | A | | 10/1988 | Fischer et al. | |
| 4,800,062 | A | * | 1/1989 | Craig et al. | 376/272 |
| 4,834,916 | A | * | 5/1989 | Chaudon et al. | 376/272 |
| 4,845,372 | A | * | 7/1989 | Mallory et al. | 250/506.1 |
| 4,847,009 | A | * | 7/1989 | Madle et al. | 588/16 |
| 4,851,183 | A | * | 7/1989 | Hampel | 376/274 |
| 4,971,752 | A | * | 11/1990 | Parker | 376/274 |
| 5,102,615 | A | * | 4/1992 | Grande et al. | 376/272 |
| 5,182,076 | A | * | 1/1993 | de Seroux et al. | 376/250 |
| 5,267,280 | A | * | 11/1993 | Duquesne | 376/260 |
| 5,297,917 | A | | 3/1994 | Freneix | |
| 5,307,388 | A | * | 4/1994 | Inkester et al. | 376/272 |
| 5,319,686 | A | * | 6/1994 | Pizzano et al. | 376/272 |
| 5,387,741 | A | * | 2/1995 | Shuttle | 588/259 |
| 5,469,936 | A | | 11/1995 | Lauga et al. | |
| 5,513,231 | A | * | 4/1996 | Jones et al. | 376/261 |
| 5,513,232 | A | * | 4/1996 | Jones et al. | 376/272 |
| 5,546,436 | A | * | 8/1996 | Jones et al. | 376/272 |
| 5,564,498 | A | * | 10/1996 | Bochard | 165/169 |
| 5,633,904 | A | * | 5/1997 | Gilligan et al. | 376/272 |
| 5,646,971 | A | * | 7/1997 | Howe | 376/272 |
| 5,661,768 | A | * | 8/1997 | Gilligan et al. | 376/261 |
| 5,753,925 | A | * | 5/1998 | Yamanaka et al. | 250/507.1 |
| 5,771,265 | A | * | 6/1998 | Montazer | 376/272 |
| 5,862,195 | A | * | 1/1999 | Peterson, II | 376/272 |
| 5,926,602 | A | | 7/1999 | Okura | |
| 6,064,710 | A | * | 5/2000 | Singh | 376/272 |
| 6,064,711 | A | * | 5/2000 | Copson | 376/287 |
| 6,252,923 | B1 | * | 6/2001 | Iacovino et al. | 376/272 |
| 6,519,307 | B1 | * | 2/2003 | Singh et al. | 376/272 |
| 6,719,000 | B1 | * | 4/2004 | Forsythe et al. | 137/202 |
| 7,068,748 | B2 | * | 6/2006 | Singh | 376/272 |
| 2006/0251201 | A1 | * | 11/2006 | Singh | 376/272 |

FOREIGN PATENT DOCUMENTS

| | | | | | |
|---|---|---|---|---|---|
| DE | 3107158 | | | 1/1983 | |
| DE | 3144113 | | | 5/1983 | |
| DE | 3151475 | | | 5/1983 | |
| DE | 340466 | | | 8/1995 | |
| DE | 19529357 | | | 8/1995 | |
| EP | 0253730 | | | 1/1988 | |
| EP | 1 06100 | A1 | | 6/2000 | |
| FR | 2434463 | | | 8/1979 | |
| GB | 2295484 | | | 4/1996 | |
| GB | 2327722 | | | 1/1999 | |
| GB | 2337722 | | | 1/1999 | |
| GB | 2337722 | A | * | 12/1999 | |
| JP | 621851999 | | | 8/1987 | |
| JP | 11202094 | A | * | 7/1999 | G21F 9/36 |
| RU | 2168022 | C | | 6/2000 | |

* cited by examiner

SYSTEM AND METHOD FOR THE VENTILATED STORAGE OF HIGH LEVEL RADIOACTIVE WASTE IN A CLUSTERED ARRANGEMENT

CROSS-REFERENCE TO RELATED PATENT APPLICATIONS

The present application claims the benefit of U.S. Patent Provisional Patent Application Ser. No. 61/016,446, filed Dec. 22, 2007, the entirety of which is hereby incorporated by reference.

FIELD OF THE INVENTION

The present invention relates generally to systems and methods of storing of high level radioactive waste, and specifically to systems and methods of storing high level radioactive waste that emits a heat load, such as spent nuclear fuel, in a clustered arrangement wherein such systems utilize natural convective cooling for ventilation.

BACKGROUND OF THE INVENTION

Concerns regarding the viability of oil as a practical energy source continue to mount throughout the world whether brought on by resource scarcity, economic climate, or strained relations with entities in possession of oil reserves. Additionally, environmental issues associated with burning oil, such as air pollution and global warming, have further put the long-term viability of oil-based energy at question. As a result, alternative energies, such as nuclear power, solar power and wind power, have become the focus of increased use and evaluation by a multitude of governments and private entities throughout the world. It is believed by many that nuclear power provides the only energy source that can realistically meet the energy needs of industrialized nations.

The fundamental concern with the use of nuclear power has been related to the disposal of the spent nuclear fuel rods after they have been depleted in the nuclear reactor. As a result, the industry continues to search for new and improved methods and systems for storing, transporting and transferring spent nuclear fuels rods. These systems must be meet carefully regulated government safety mandates regarding radiation containment, structural integrity, adequate ventilation, etc.

An example of an existing ventilated storage system (and its associated method of storage and transfer) are disclosed in U.S. Pat. No. 7,330,526 (the '526 patent), issued Feb. 12, 2008 to Krishna P. Singh, one of the present inventors of the present application. Another suitable existing ventilated storage system (and its associated methods of storage and transfer) are disclosed in U.S. Pat. No. 7,068,748 (the '748 patent), issued Jun. 27, 2006 to Krishna P. Singh. The entireties of these applications are incorporated by reference herein. The systems and methods disclosed in the '526 and '748 patent are extremely useful and effective as they are designed to utilize the naturally existing radiation shielding properties of the ground to increase the radiation containment abilities of the systems while still affording adequate ventilation. While these designs are adequate, and even optimal, in many circumstances, these systems can not be universally used at all existing spent nuclear fuel storage sites, whether temporary or long-term, for a number of factors. Such factors may include existing capital equipment at the site, geographic layout, climate, space limitations, etc.

For obvious reasons, storage space at any storage site, whether temporary or long-term, is at a premium. Thus, one of the major considerations in any storage system is the maximization of storage capacity per area (or volume). To this extent, storage systems that provide storage cavities in an arrayed configuration have been developed. An example of an arrayed underground storage system is disclosed in United States Patent Application Publication 2006/0251201, published Nov. 9, 2006, to Krishna P. Singh.

Another above-grade arrayed storage system is also disclosed in UK Patent Application Publication GB2337772A, published Jan. 12, 2999, to Blackbourn et al. The Blackbourn system for storing canisters containing hot spent nuclear fuel or waste. The Blackbourn system stores the canister in respective chambers of a vault and are air-cooled by natural convection. The vault is constructed from pre-cast concrete sections, assembled on-site and secured together by poured concrete. Each chamber has a stainless steel liner defining inner and outer annular spaces between the hot wall of the canister and the concrete wall of the chamber through which cooling air flows by convection. Air from the outer space discharges via exit vents cast into the concrete, air from the inner space via gap between metal lid and flanges. The liner shields the concrete from direct thermal radiation from the hot canister wall and provides additional surfaces from which heat can be lost by convection. The inner metal-lined air path prevents very hot air from coming into direct contact with concrete. Slots allow hot air to discharge via one of the exit vents in the event of blockage of the other. The concrete walls themselves are cooled by further ducts formed as an integral part of the pre-cast structure.

While the Blackbourn system is a suitable structure, it suffers from a number drawbacks. For example, the concrete structures between the separated and isolated storage chambers is susceptible to being subjected to overheating and eventual degradation. Moreover, by surrounding each chamber with a concrete structure, additional space is occupied per chamber, thereby increasing the overall size of the vault without achieving increased storage capacity.

Additionally, by designing the Blackbourn vault so that each storage chamber acts as its own independent ventilated system, the proper ventilation of any single chamber can be easily choked off by the blocking of only a few inlet ducts. Finally, the Blackbourn system does not accommodate thermal expansion of its metal parts adequately, thereby exposing certain components to great stresses and increasing the possibility of eventual fatigue and failure.

SUMMARY OF THE INVENTION

It is therefore an object of the present invention to provide an improved system and method of storing and/or transferring high level radioactive waste.

Another object of the present invention is to provide a system and method of storing high level radioactive waste that utilizes natural convection cooling (i.e., the chimney effect).

Still another object of the present invention is to provide a system and method of storing high level radioactive waste that utilizes natural convection cooling (i.e., the chimney effect) that can store containers in an array of tightly clustered storage chambers.

Yet another object of the present invention is to provide a system and method of storing high level radioactive waste that utilizes natural convection cooling (i.e., the chimney effect) wherein the storage shells provide additional structural integrity to the system.

A further object of the present invention is to provide a system and method of storing high level radioactive waste wherein the storage shells act as load bearing columns for the roof a radiation containment enclosure.

In one aspect, the invention can be a system for receiving and storing high level radioactive waste comprising: a concrete enclosure comprising walls, a roof and a floor, the concrete enclosure forming an internal space; the roof comprising an array of holes; an array of metal shells, each metal shell having a cavity for accommodating one or more containers holding high level radioactive waste, the array of metal shells arranged in a substantially vertical and spaced apart manner within the internal space of the enclosure, the array of the metal shells being co-axial with the array of holes in the roof so that containers holding high level radioactive waste can be lowered through the array of holes in the roof and into the cavities of the array of metal shells; the array of metal shells fastened to the floor and to the roof of the concrete enclosure, the array of metal shells acting as load bearing columns for the roof; each of the metal shells comprising (i) an expansion joint for accommodating thermal expansion and/or contraction of the metal shells; and (ii) one or more holes at a bottom portion of the metal shell that create a passageway between the internal space of the concrete enclosure and the cavity of the metal shell; and the walls of the concrete enclosure comprising one or more inlet ventilations ducts forming passageways from outside of the concrete enclosure to the internal space of the concrete enclosure.

In another aspect, the invention is a system for receiving and storing high level radioactive waste comprising: an enclosure comprising walls having inlet ventilation ducts, a roof comprising an array of holes, and a floor; an array of metal shells located in an internal space of the enclosure, the array of metal shells being co-axial with the array of holes in the roof so that containers holding high level radioactive waste can be lowered through the array of holes in the roof and into the array of metal shells; the array of metal shells acting as load bearing columns for the roof; and each of the metal shells comprising (i) an expansion joint for accommodating thermal expansion and/or contraction of the metal shells; and (ii) one or more holes at a bottom portion of the metal shell.

DETAILED DESCRIPTION OF THE DRAWINGS

Figure 1:
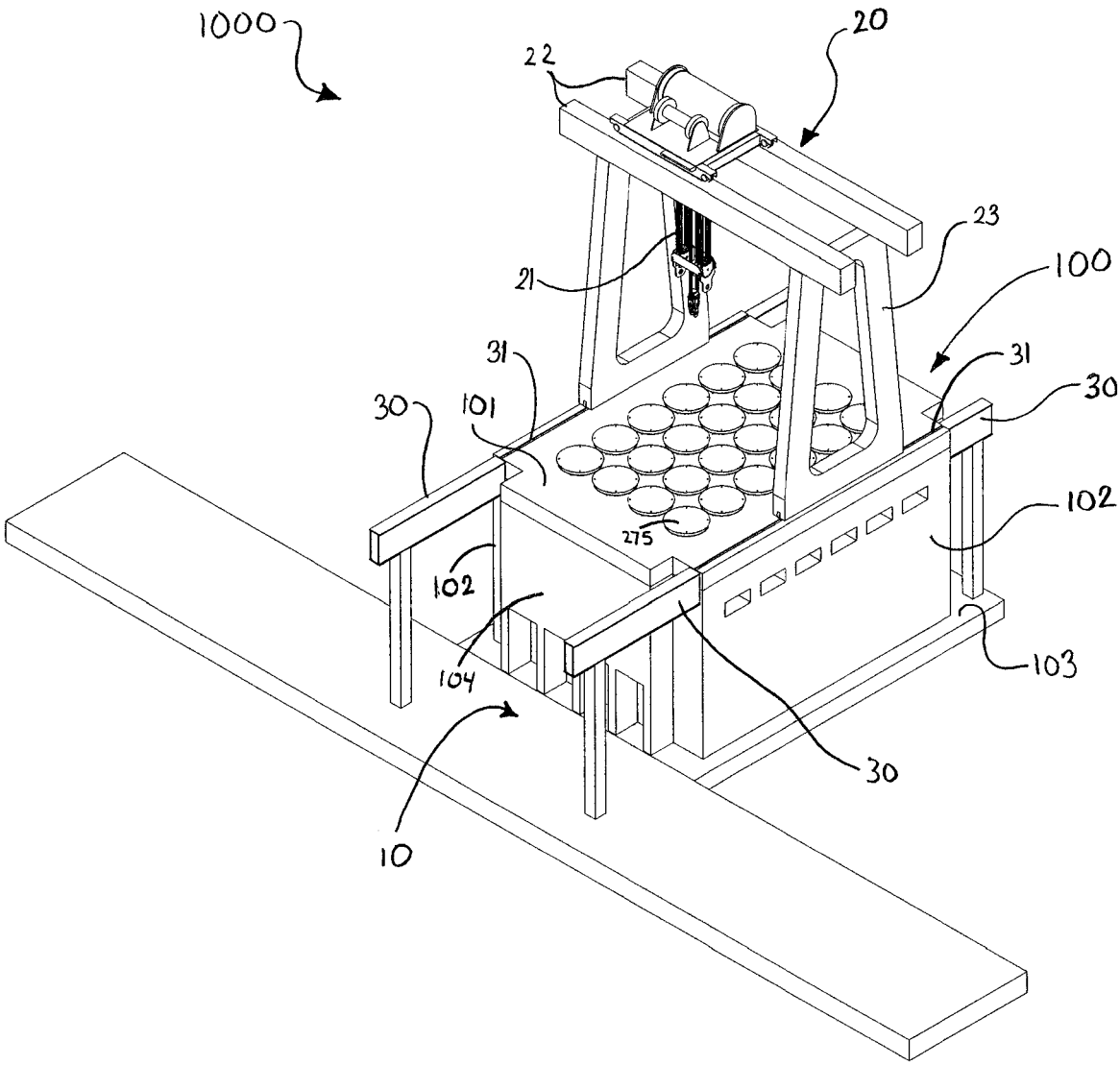
FIG. 1 is a perspective view a clustered storage system according to one embodiment of the present invention.

Referring first to FIG. 1, a clustered storage system 1000 is illustrated according to an embodiment of the present invention. The clustered storage system 1000 is specifically designed to achieve the dry storage of multiple hermetically sealed containers containing spent nuclear fuel in an above-grade environment. However, it should be understood that many of the inventive concepts can be applied to a below grade environment with a simple re-configuration of the inlet vents.

Generally speaking, the clustered storage system 1000 is designed to facilitate the receipt, transfer and ventilated storage of containers storing spent nuclear fuel or other high level radioactive waste. The clustered storage system 1000 is a vertical, ventilated dry spent fuel storage system that is fully compatible with 100 ton and 125 ton transfer casks for spent fuel multi-purpose canister transfer operations. The clustered storage system 1000 can, however, be modified/designed to be compatible with any size or style transfer cask. The clustered storage system 1000 is designed to accept multiple spent fuel multi-purpose canisters for storage at an Independent Spent Fuel Storage Installation ("ISFSI") in a compact, ventilated and structurally sound enclosure.

All container types engineered for the dry storage of spent fuel can be stored in the clustered storage system 1000. Suitable containers include multi-purpose canisters and thermally conductive casks that are hermetically sealed for the dry storage of high level wastes, such as spent nuclear fuel. Typically, containers comprise a honeycomb grid-work/basket, or other structure, built directly therein to accommodate a plurality of spent fuel rods in spaced relation. An example of a multi-purpose canister that is particularly suitable for use in the present invention is disclosed in U.S. Pat. No. 5,898,747 to Krishna P. Singh, issued Apr. 27, 1999, the entirety of which is hereby incorporated by reference in its entirety. An example of a thermally conductive cask that is suitable for use in the present invention is disclosed in U.S. Patent Application Publication No. 2008/0031396, to Krishna P. Singh, published Feb. 7, 2008, the entirety of which is hereby incorporated by reference in its entirety.

The clustered storage system 1000 is a storage system that facilitates the passive cooling of stored containers through natural convention/ventilation. The clustered storage system 1000 is free of forced cooling equipment, such as blowers and closed-loop cooling systems. Instead, the clustered storage system 1000 utilizes the natural phenomena of rising warmed air, i.e., the chimney effect, to effectuate the necessary circulation of air throughout the system.

Referring still to FIG. 1, the clustered storage system 1000 generally comprises a container receiving area 10, a gantry crane 20 a frame crane support structure 30 and a concrete enclosure 100. The container receiving area 10 can take on variety of embodiments and include a variety of infrastructure and capital equipment depending on the desired method of container delivery to the clustered storage system 1000. For example, the container receiving area 10 can comprise one or more sets of tracks for rail cars or the like so that rails cars carrying transfer containers (such as transfer casks holding a loaded multipurpose container or a thermally conductive cask) can be stopped in a position within reach of the gantry crane 20 for unloading and positioning above the concrete enclosure 100. In other embodiments, the container receiving area 10 may be designed as a dock to accommodate trucks for loading and/or unloading.

The frame structure 30 extends from the concrete enclosure 100 and into the container receiving area 10. The frame structure 30 along with the top surface of the roof 101 of the concrete enclosure 100 are adapted so that the gantry crane 20 can translate between a position above the container receiving area 10 where it can engage and lift containers from a transport vehicle (such as a rail car, truck, crane, etc.) and a position above the roof 101 of the concrete enclosure 100. The gantry crane generally comprises a vertical lifting mechanism 21, an upright frame 23 and a set of rails 22 upon which the lifting mechanism 21 can translate. The lifting mechanism 21 is of the type well known in the art for multi-purpose canister transfer procedures, including a lift yoke, a hoist and the necessary motors. Both the lift yoke and handling hoist are single-failure proof.

In the illustrated embodiment, a set of rails 31 are incorporated into (or onto) the roof 101 of the concrete enclosure 100 and the frame structure 30 along which the gantry crane 20 rides. The sections of the rails 31 built into the enclosure 100 are positioned on the roof 101 so as to be vertically aligned with the walls 102 of the enclosure 100, thereby ensuring that the load imparted by the gantry crane 20 and its load are borne by the walls 102, which in turn transfer the load to the foundation 103. The rear section of the frame structure 30 also rests atop the foundation 103 via its rear load bearing columns. The front section of the frame structure 30 (which extends into the canister loading area 10) also comprises load bearing columns that are adequately founded. In an alternative embodiments of the invention, the gantry crane 20 can be supported and translated upon rails that are not built into the enclosure 100 itself. In such an embodiment, the rails for the gantry crane 20 could run adjacent the enclosure 100 atop a frame structure or other load bearing assembly.

The height of the gantry crane 20 is sized so that it can vertically lift a container to a sufficient height so that the bottom of the container clears the roof of the concrete enclosure 100. The gantry crane 20 can translate the container in a first horizontal direction by moving along the rails 31 and in a second horizontal direction by sliding the lifting mechanism 21 along the crane's rails 22. As a result, the gantry crane 20 can position a container above the roof of the concrete enclosure 100 and in precise axial alignment with any of the storage chambers (discussed in detail below) within the concrete enclosure 100 to facilitate the transfer procedure of the spent nuclear fuel into the desired storage chambers.

Figure 2:
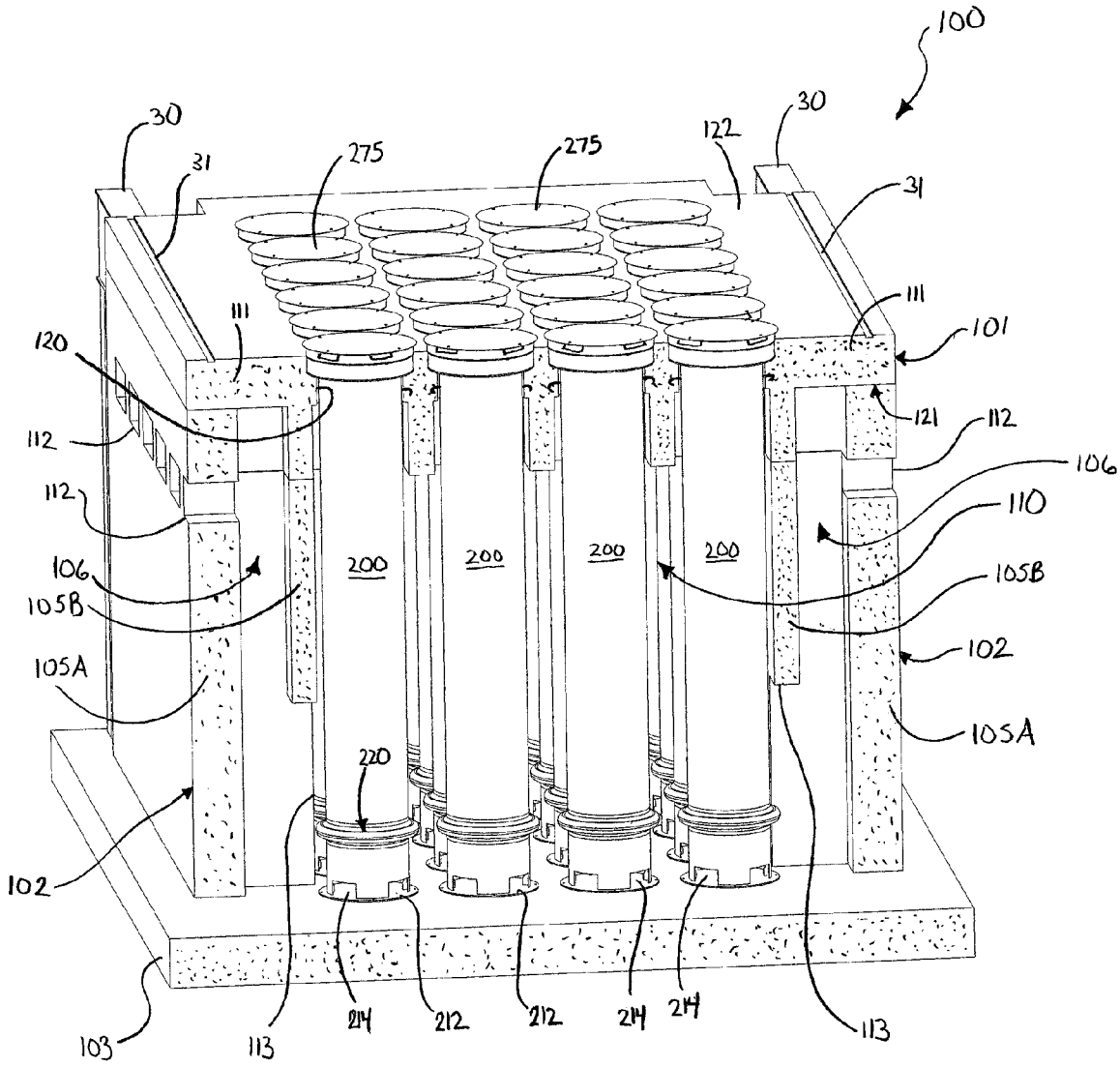
FIG. 2 is a perspective view of the ventilated enclosure of the clustered storage system of FIG. 1 wherein the front wall of the enclosure is removed.
Figure 3:
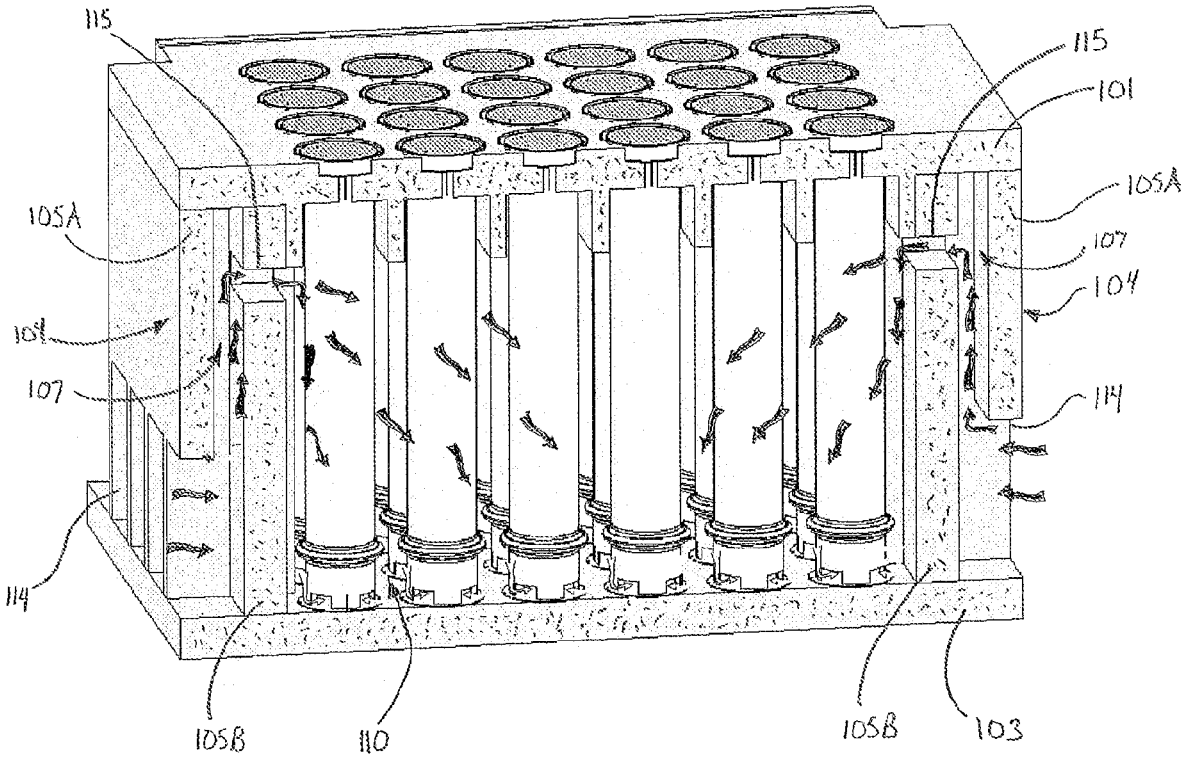
FIG. 3 is a perspective view of the ventilated enclosure of the clustered storage system of FIG. 1 wherein the side wall of the enclosure is removed.

Referring now to FIGS. 2-3 concurrently, the details of the concrete enclosure 100 will now be discussed. In the illustrated embodiment, the concrete enclosure 100 is a rectangular box-like structure that is designed to provide the necessary neutron and gamma radiation shielding. However, it is to be understood that the shape of the concrete enclosure 100 can take on other shapes and still incorporate the various principles of the present invention. For example, the enclosure 100 can be cylindrical, a truncated pyramid, dome-like, irregularly shaped or combinations thereof.

The concrete enclosure 100 is a building-like structure that forms an internal space 110 that houses a plurality of metal storage shells 200. The concrete enclosure 100 is formed by the structural cooperation of the side walls 102, the end walls 104, the roof slab 101, and the foundation 103. The components 101-104 of the enclosure 100 are preferably formed of reinforced concrete. Of course, other materials or combinations of materials can be used so long as the necessary radiation containment requirements are met. Additionally, in some embodiments of the concrete enclosure 100, one or more of the inner surfaces of the components 101-104 that form the internal space 110 may be lined with a metal, such as steel, to protect against degradation from the heat and radiation loads emanating from the high level radioactive waste stored in the storage shells 200.

Figure 4:
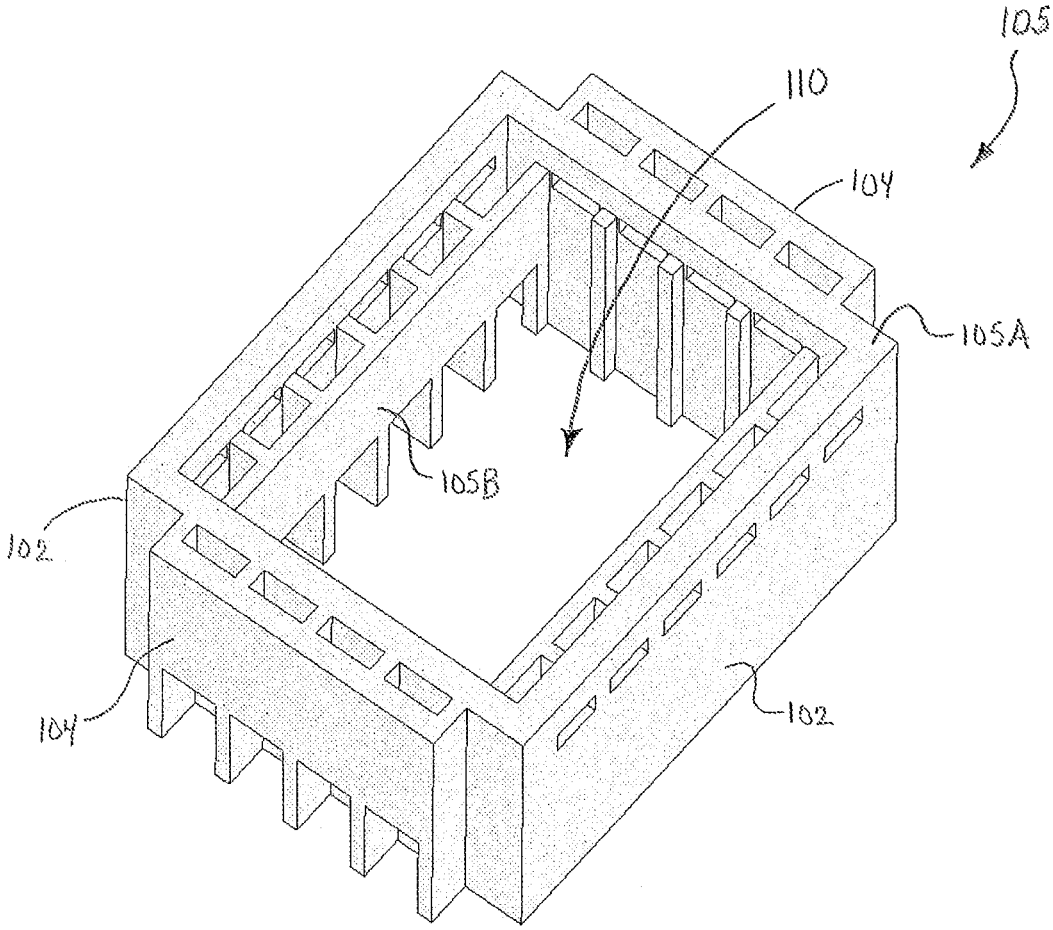
FIG. 4 is a top perspective view of the wall section of the ventilated enclosure of the clustered storage system of FIG. 1.

Referring now to FIGS. 2-4 concurrently, the side walls 102 and the end walls 104 together form a wall assembly. The side walls 102 and the end walls 104 are constructed of two overlapping wall structures 105A, 105B, that can be formed as inter-fitting monolithic structures. The wall structures 105A, 105B are keyed to mate with vertical reinforced columns that stand on the foundation 103. Thus, the wall structures 105A, 105B can expand and contract without loading the columns. The wall structures 105A, 105B are specifically shaped so that when they are fitted together to form the wall assembly 105, air inlet ventilation ducts 106, 107 are formed in the side walls 102 and the end walls 104 respectively. The details of these air inlet ventilation ducts 106, 107 will be discussed in greater detail below.

Referring now to FIGS. 1-2 concurrently, the foundation 103 of the enclosure 100 is a monolithic reinforced concrete slab, designed to support the necessary loading and to provide additional radiation shielding for the ground. The foundation also serves to prevent below-grade liquids from seeping into the internal space 110.

Figure 5A:
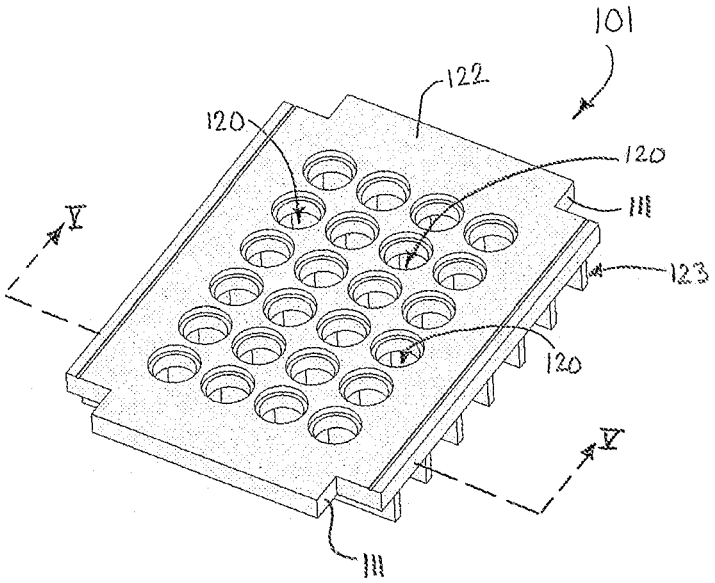
FIG. 5A is a top perspective view of the roof slab of the ventilated enclosure of the clustered storage system of FIG. 1.
Figure 5B:
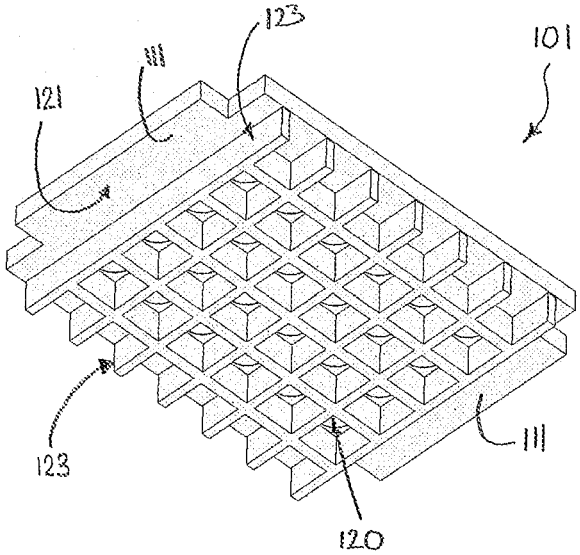
FIG. 5B is a bottom perspective view of the roof slab of FIG. 5A.
Figure 5C:
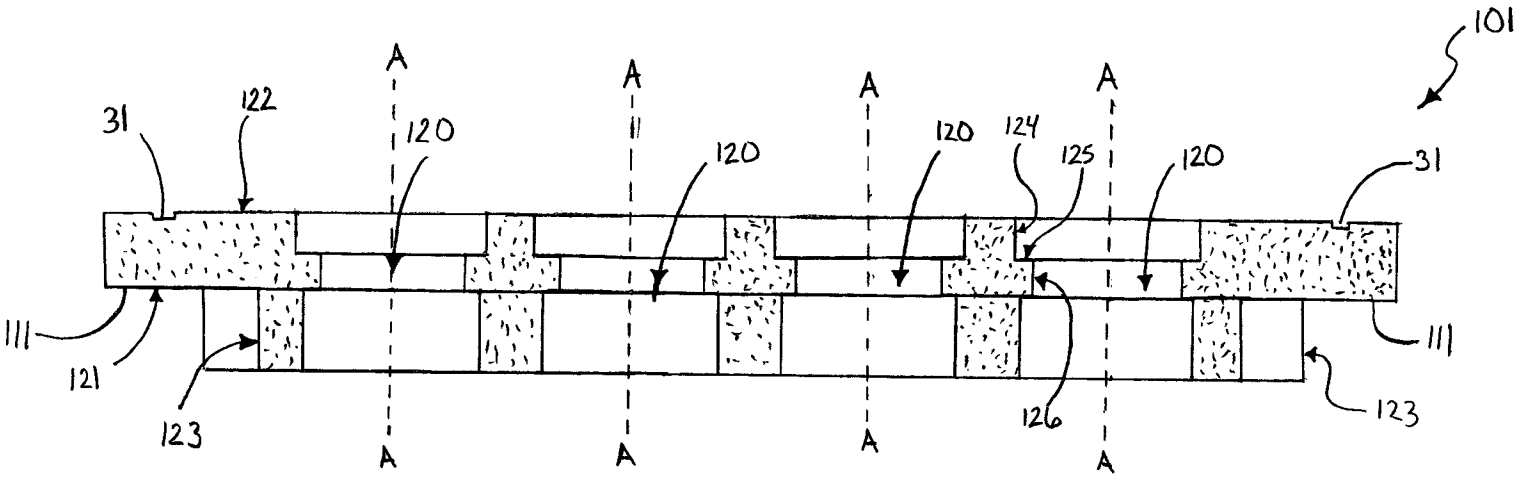
FIG. 5C is a cross-sectional view of the roof slab of FIG. 5A. along line V-V.

Referring now to FIGS. 5A-5C, the roof 101 of the concrete enclosure 100 is formed as a monolithic reinforced concrete structure that is designed to matingly engage with the wall assembly 105 when lowered thereon (i.e., as assembled in FIGS. 1-3). To this extent, the roof 101 has flange portions 111 that rest atop the top edges of the end walls 104.

The roof 101 comprises an array of holes 120 that extend through the slab, thereby forming passageways through the roof 101 from the bottom surface 121 to the top surface 122 of the roof 101. As used herein, the term "array" is not intended to be limited to elements arranged in a row and column format but is intended to include, without limitation, any arrangement of a plurality of spaced apart elements.

A gridwork of intersecting beams 123 are formed into and protruding from the bottom surface 121 of the roof slab 101. The gridwork of beams 123 are formed as part of the concrete monolithic roof structure 101 but can also be formed as a separate structure that is later connected to the main slab. The gridwork of beams 123 are designed to form a concrete wall extending from the bottom surface 121 that surrounds the perimeter of each hole 120, thereby separating the holes 120 for a short distance. The gridwork of beams 23 is provided to shield the exterior environment (and personnel) during the loading of a particular storage shell 200 from radiation shine emanating from an adjacent loaded storage shell 200. Stated simply, the gridwork of beams 23 eliminates the possibility of radiation shine through an open hole 120 from spent nuclear fuel already within the enclosure 100 by shielding any angled escape. It should be noted that the structure surrounding the perimeter of the holes 120 is not limited to a gridwork arrangement. For example, in an alternative embodiment, a collar of concrete (or another material) can be formed or fastened to the bottom surface 121 of the roof slab 101 around each hole 120. In still other embodiment, the portion of the slab comprising the array of holes 120 may simply be made thicker and bored out (our molded accordingly).

As best illustrated in FIG. 5C, each of the holes 120 is formed/delineated by a stepped surface comprising a first riser surface 124, a tread surface 125 and a second riser surface 126. As will be discussed in detail below, the stepped surface of the holes 120 are designed to correspond to the top portion of the storage shells 200 in size and shape. The holes 120 accommodate the top portion of the storage shells 200. There is no limitation on the shape of the holes 120 however in other embodiments.

When the enclosure 100 is assembled, the axis A-A of the holes 120 are substantially vertical, and as discussed below, when the storage shells 200 are inserted, are also in alignment with the axis of the storage shells 200.

Referring back to FIGS. 2-3 concurrently, the side walls 102 and end walls 104 respectively comprise inlet ventilation ducts 106, 107. The inlet ventilation ducts 106, 107 provide passageways from the external environment to the internal space 110 of the concrete structure 100 so that cool air can enter and fill the internal space 110 (and eventually be drawn into the shells 200 for cooling of the loaded containers). The air flow is indicated in FIG. 3 by the black arrows. While both the inlet ventilation ducts 106, 107 form serpentine and tortuous passageways, the inlet ventilation ducts 106 are purposely made to have a different design/layout than that of the inlet ventilation ducts 107. Specifically, each of the inlet ventilation ducts 106 extend from an opening 112 located near the top of the outer surface of the side wall 102 to an opening 113 located near the bottom of the inner surface of the side wall 102. To the contrary, each of the inlet ventilation ducts 107 extend from an opening 114 located near the bottom of the outer surface of the end wall 104 to an opening 115 located near the top of the inner surface of the end wall 104. The different openings 112-115 are illustrated well in FIG. 4.

As a result of the different designs of the inlet ventilation ducts 106, 107, the internal space 110 of the enclosure 100 is provided with incoming cool air at different heights within the space 110, thereby effectively circulating the cool air throughout the entirety of the internal space and against the height of the shells 120 which will assist in cooling. Furthermore, by providing a plurality of spaced-apart inlet ventilation ducts 106, 107 which circumferentially surround the internal space 110 which houses the entire cluster of storage tubes 200, adequate and continuous ventilation of the internal space 110 (and thus all storage shells 200) is ensured and the danger of any one storage chamber being choked off is eliminated. Of course, in other embodiments, only one type of inlet ventilation duct may be used.

As mentioned in passing above, the inlet ventilation ducts 106, 107 form serpentine and tortuous passageways from the external of the enclosure 100 to the internal space 110. In all embodiments, however, the passageways may not be serpentine or tortuous, so long as direct line of sight does not exist through the passageways formed by the inlet ventilation ducts 106, 107 from exterior of the enclosure 100 to the storage shells 200 within the internal space 110. For example, the inlet ducts could be sufficiently angled or V-shaped The openings 114, 112 in the outer surface of walls 102, 104 are equipped with grates, which can be constructed of heavy metal, that permit air inflow but protects against intrusion by a vehicle, animal or man. Screens may also be used to prevent inset ingress.

Referring still to FIGS. 2-3 concurrently, the clustered storage system 1000 further comprises an array of prismatic storage shells 200 arranged within the internal space 110 formed by the concrete enclosure 100. The array of storage shells 200 are arranged within the internal space 110 in a tightly spaced and substantially vertical orientation. The storage shells 200 extend from the foundation 103 (which acts as the floor of the internal space 110) to the roof 101 of the enclosure 101. The storage shells 200 are integrally fastened to both the floor 103 and the roof 101, thereby providing load bearing support to the roof 101. Stated simply, the storage shells 200 act as load bearing columns.

The additional structural support added by the storage shells 200 to the roof slab 101 assists in ensuring that the roof slab 101 does not fail when subjected to repeated load cycling experienced during container transfer procedures. For example, when the clustered storage system 1000 is used to store multi-purpose canisters ("MPCs") holding spent nuclear fuel, the MPCs will be brought to the clustered storage system 1000 in transfer casks which can typically weight as much 100-125 tons. During the transfer procedure according to the present invention, a transfer cask (which houses the MPC) is positioned atop the roof 101 and operably coupled to one of the open storage shells 200 with a mating device. One suitable example of a mating device and the corresponding MPC transfer procedure is disclosed in U.S. Pat. No. 6,625,246, issued Sep. 23, 2003, to Krishna P. Singh, the entirety of which is hereby incorporated by reference. During this transfer procedure, the roof 101 experience substantial loading, which is repeated during every loading/unloading sequence. If the roof 101 were to fail or crack, such a failure would be catastrophic for the whole system as the integrity of the entire enclosure 100 would be compromised, allowing radiation from previously loaded storage shells 200 to leak out. Thus, the structural integrity of the roof 101 must be preserved.

Utilizing the storage shells 200 as load bearing columns for the roof 101 allows for the maximization of storage capacity per area/volume of the system 1000 and eliminates the need for additional structural supports, which occupy valuable potential storage space. As a result, the storage shells 200 can be tightly clustered in manner unprecedented in previous systems.

The array of storage shells 200 are co-axially aligned with the array of holes 120 in the roof 101 so that containers loaded with high level radioactive can be lowered through the holes 120 in the roof 101 and into the cavities 201 (FIG. 6) of the storage shells 200. The storage shells 200 are located within the internal space 110 so as to be located within a single uninterrupted volume wherein the cool air inflow is fed by the same set of inlet vents 106, 107. Stated another way, the internal space 110 of the concrete enclosure 100 is not divided into spatially isolated sections and all of the storage shells 200 are located within that uninterrupted volume. With the exception of stringers or struts that may be added to connect adjacent storage shells 200 for horizontal structural integrity in earthquake vulnerable regions, the spaces between adjacent storage shells 200 are left empty within the internal space 110 of the concrete enclosure 100.

Referring now to FIGS. 6-9 concurrently, the structural details of one of the storage shells 200 will be described with the understanding that all shells 200 in the array are constructed in an identical manner. The storage shell 200 is a generally elongated tubular structure extending from a top portion 201 to a bottom portion 202 and having an axis B-B. The storage shell 200 is preferably constructed of a metal, such as steel. Of course, other materials and metals can be used if desired. The storage shell 200 defines an internal storage cavity 203 for receiving and accommodating one or more containers 300 holding spent nuclear fuel.

The length of the shell 200 can be sized to accommodate a single container 300 or a plurality of containers 300 stacked atop one another inside of the cavity 203. The width of the shell (i.e., the cavity 203) is preferably sized and shaped so as to have a horizontal cross-section that accommodates only a single container 300, such as a single MPC or a single thermally conductive cask, so that an annular clearance 204 (i.e., a gap) exists between the outer surface 301 of the container 300 and the inner surface 205 of the storage shell 200. In one embodiment, the cavity 203 of the storage shell 200 has a diameter that is in the range of 6 to 10 inches larger than the diameter of the container 300 it is used to store. Of course, other dimensional ranges are possible. By designing the shell 200 so that only a small clearance 205 exists between the inner surface 205 of the shell 200 and the outer surface of the container 300, the shell 200 provides lateral support to the container 300 under earthquake and other hazardous loadings.

The clearance 204 is maintained by spacer plates 206, which are tapered at their top and bottom edges to facilitate in guiding the container 300 during loading and unloading procedures. Sets of the spacer plates 206 are located circumferentially about the inner surface 205 of the shell 200 and at different axial positions along the length.

The shell 200 generally comprises a first tubular section 207, a flange plate 208, and a second tubular section 209. The first tubular section 207 forms the storage cavity 203. The flange plate 208 surrounding the top of the first tubular section 207 and extends radially outward therefrom. The second tubular section 209 extends upward from an outer edge of the flange plate 208. This portion of the shell 200 is designed to correspond to the stepped surface of the holes 120 of the roof 101 of the enclosure 100.

A plurality lid support brackets 210 are connected atop the flange plate 208 and to the inner surface of the second tubular member 209. The lid support brackets 210 are circumferentially spaced about the flange plate 208 so as to provide nesting and support structure for the lid 250. In the illustrated embodiment, the lid support brackets 210 are generally L-shaped brackets having a tapered upper edge to guide the lid 250 into position so that it nests within the second tubular section 208. The lid support brackets 210 not only provide support but also provide lateral confinement of the lid 250 within the second tubular section 208 in the event of horizontal loading during earthquakes or other events.

Figure 8:
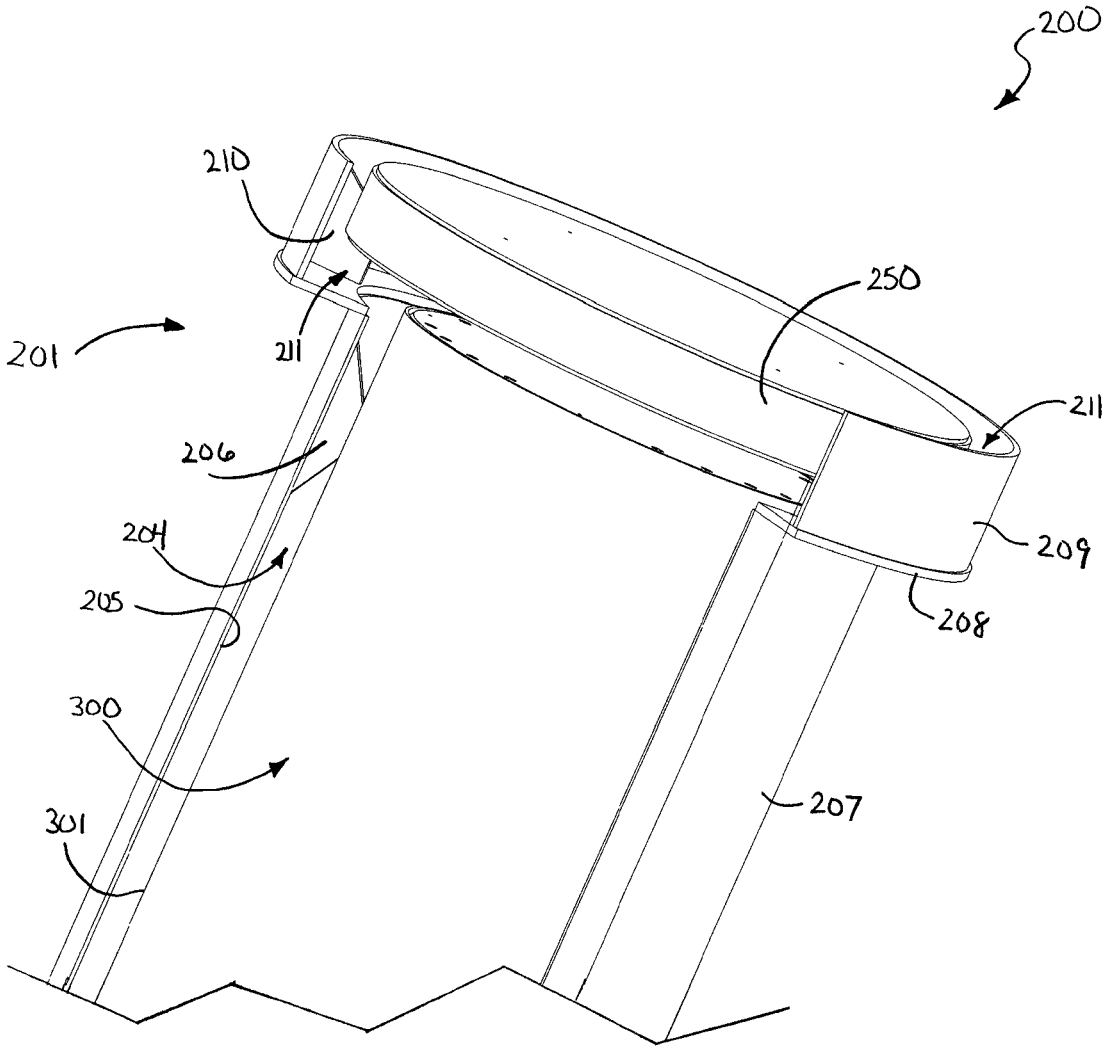
FIG. 8 is a perspective view of the top portion of one of the storage shells accommodating a multi-purpose canister showing the outlet air path detail of the clustered storage system of FIG. 1.

As can be seen best in FIG. 8, the lid support brackets 210 supports the lid 250 in a spaced apart manner from both the flange plate 208 and the second tubular section 209, thereby creating air outflow passageways 211 between the cavity 203 (or the clearance gap 204 when loaded) and the external atmosphere of the enclosure 100. Thus, air heated by the container 300 is allowed to escape the system 1000. It should be noted that other ventilated lid structures can be used in conjunction with this system 1000, including those of the type disclosed in U.S. Pat. No. 7,330,526, issued Feb. 12, 2008 to Krishna P. Singh.

Figure 6:
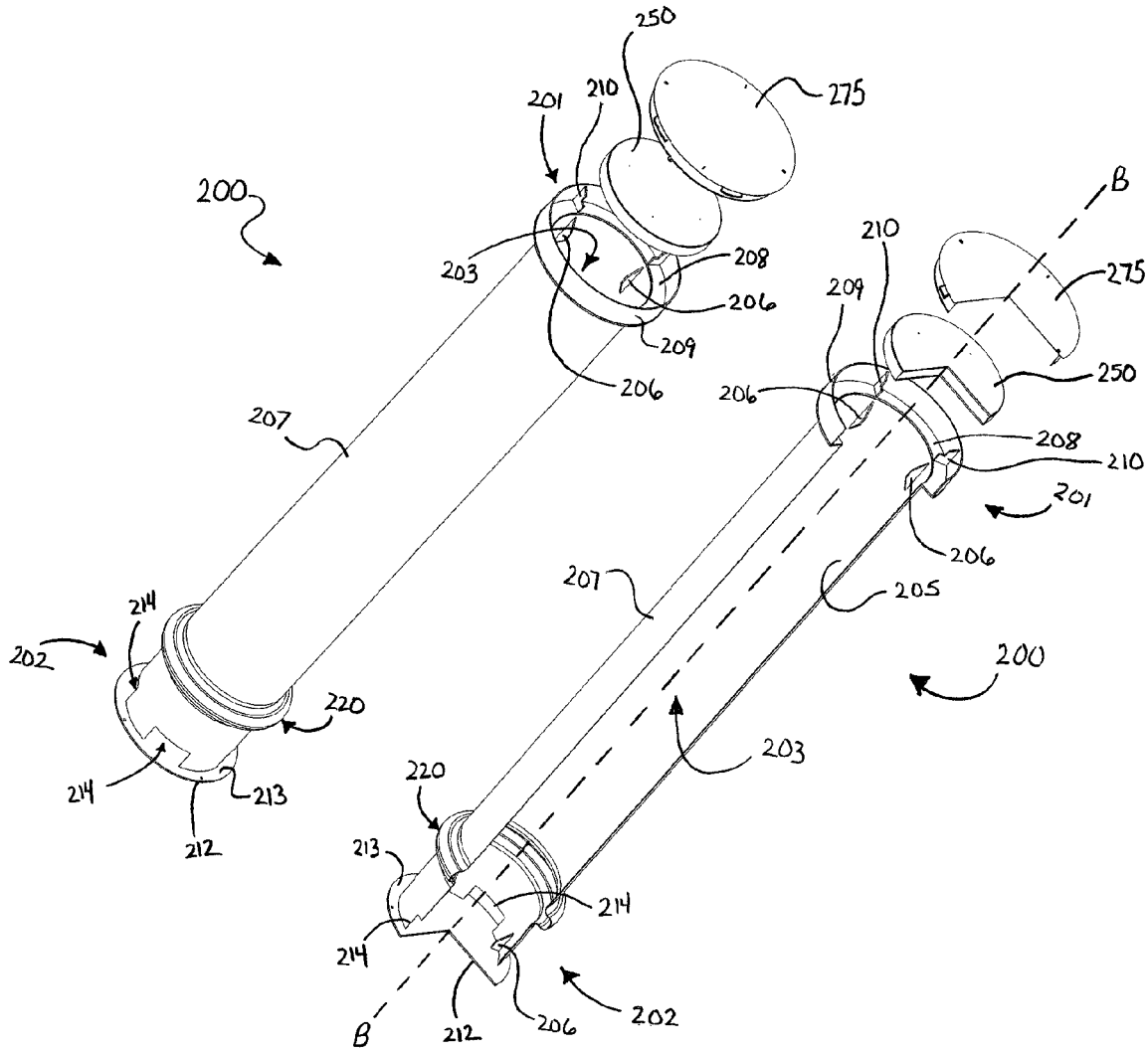
FIG. 6 is a perspective view of one of the storage shells removed from the ventilated enclosure of the clustered storage system of FIG. 1, shown in full and partial transverse section.
Figure 7:
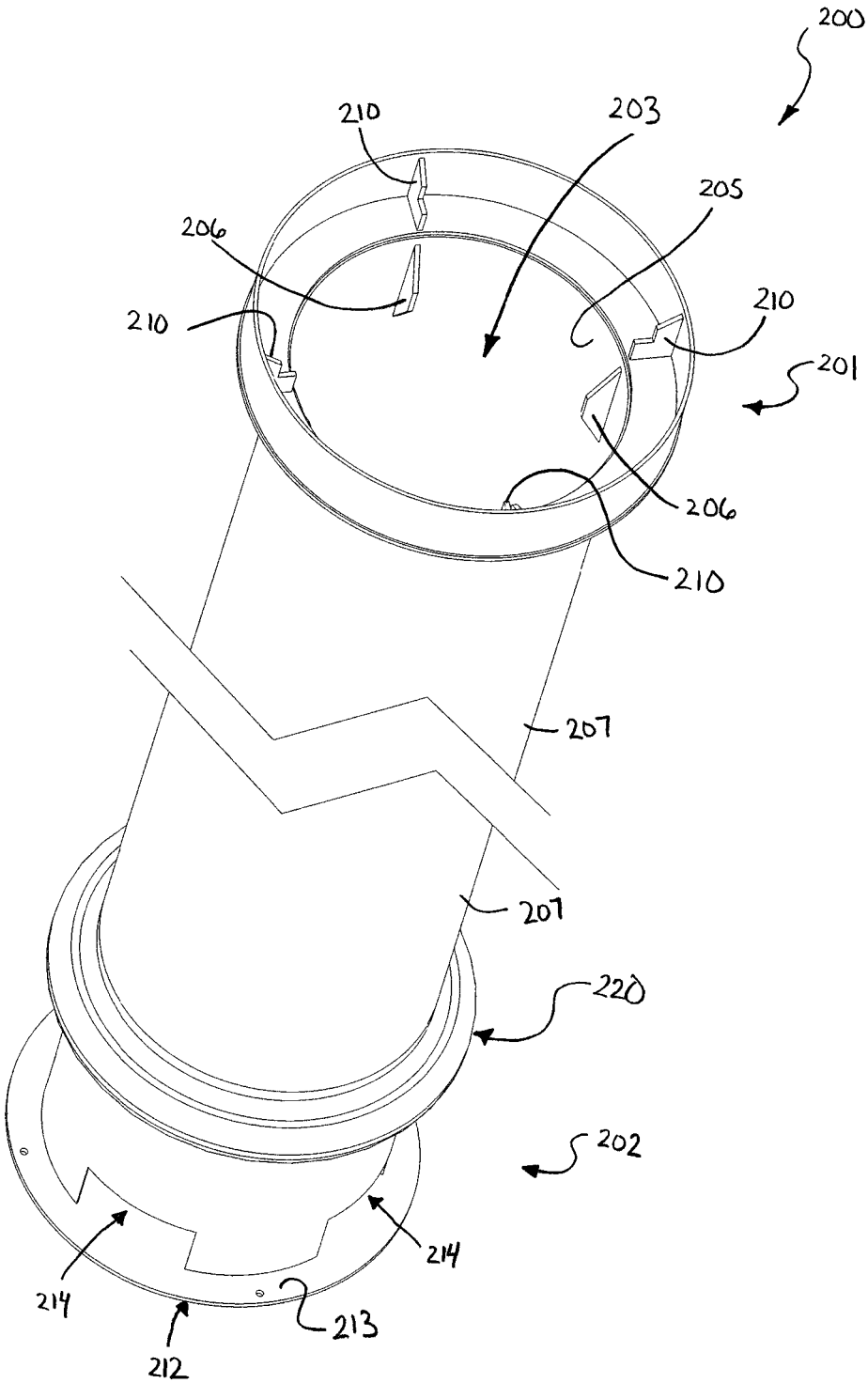
FIG. 7 is a top perspective view of one of the storage shells removed from the ventilated enclosure of the clustered storage system of FIG. 1, showing the top and bottom sections in detail and the lid removed.

Referring now to FIGS. 6-7 concurrently, a floor plate 212 is connected to the bottom edge of the first tubular section 207. The floor plate 212 provides a bottom flange 213 so that the shell 200 can be fastened secure to the foundation 203 when installed.

A plurality of openings 214 are provided in the bottom of the first tubular section 207. These opening 214 can be preformed or cutout. The openings 214 create a passageway from exterior of the shell 200 to the internal cavity 203. When installed in the enclosure 100, the openings 214 form cool air inflow passageways between the internal space 110 of the enclosure and the cavity 203 of the shell, thereby allowing cool air to come into contact with the containers 300, become heated thereby, rise within the gap 204 as warmed air, and exit the system 100 via the outflow passageways 211 around the lid 250.

The shells 200 also comprise an expansion joint 220. Because the top and bottom of the shells 200 are integrally fastened to the foundation 103 and roof 101 respectively, and because the shells 200 undergo thermal cycling and thus will need to expand and contract, the expansion joint 220 allows the thermally induced stresses within the shells 200 to release while affording the shells 200 the ability to act as load bearing columns for the roof 101. The expansion joint 220 is preferably a collar style expansion joint that is built into the shell 200. One type of expansion joint 220 that is suitable for the present invention is a flanged and flued expansion joint, the type which are commonly utilized in heat exchangers and pressure vessels. Examples of such flanged and flued expansion joints, along with design principles, are disclosed in *Mechanical Heat &changers and Pressure Vessels*, Chapter 15, by Singh, Krishna P. & Soler, A. I., Arcturus Publishers, 1984.

Figure 9:
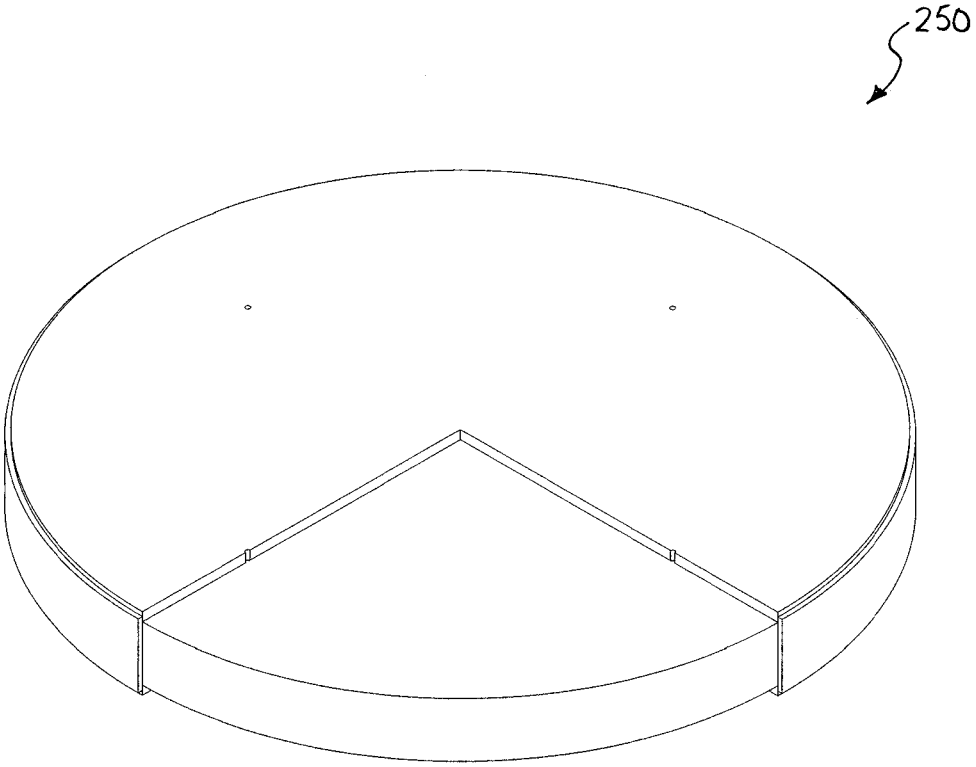
FIG. 9 is a perspective view of a lid used to close the metal shells of the clustered storage system of FIG. 1, wherein a pie-shaped section of the metal outer casing is removed to show the concrete fill.

Referring now to FIG. 9, the lid 250 is a concrete disc with a steel liner. The lid 250 performs the required gamma and neutron radiation shielding for the open top end of the cavity 203 when in place. The lid comprises lifting appurtenances.

Figure 10:
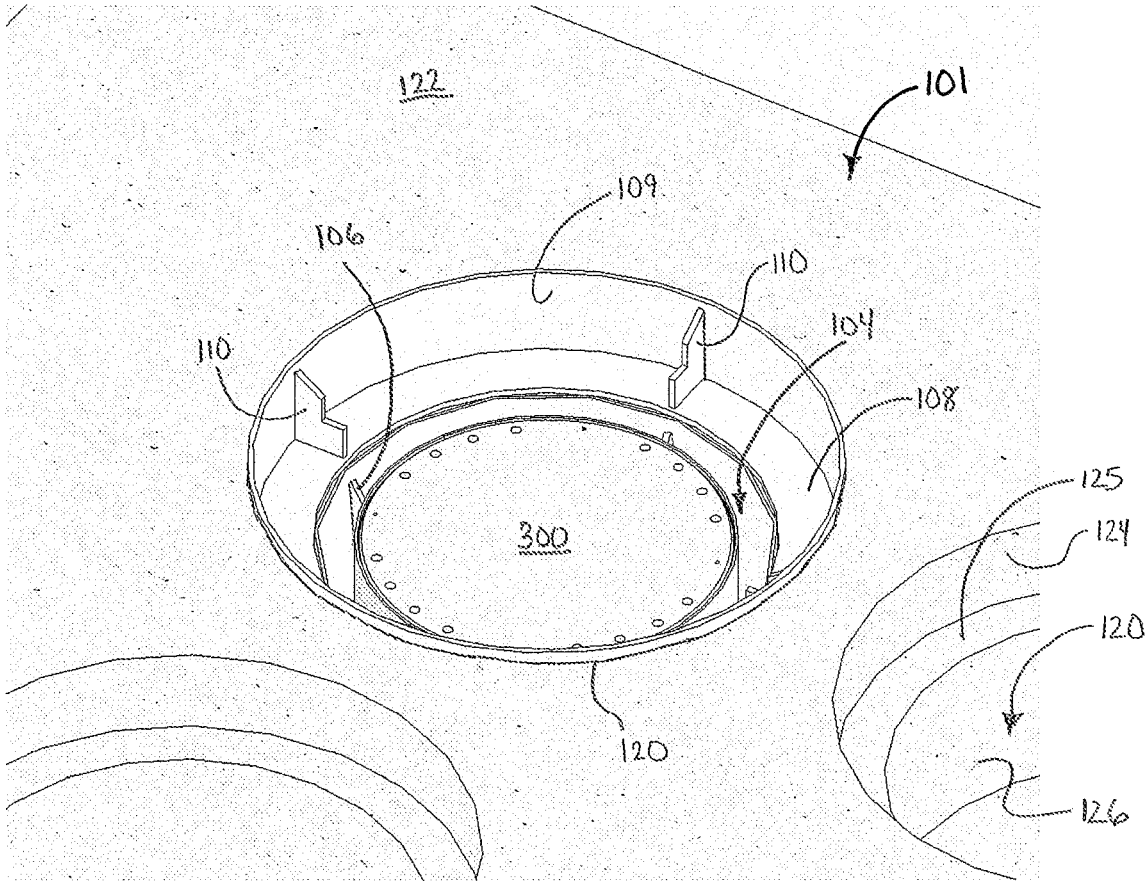
FIG. 10 is a close-up view of one of the storage chambers of the clustered storage system of FIG. 1 from above the roof slab wherein the lid and weather cover are removed.

Referring now to FIGS. 2 and 10 concurrently, the installation of the shells 200 within the concrete enclosure 100 will be described. To begin, each shell 200 is inserted through the desired hole 120 of the roof 101 until the flange plate 208 of the shell 200 contacts and rests atop the tread surface 125 of the stepped surface of the hole 120. The shells 200 are constructed to accord with the height of the enclosure 100 so that the floor plates 212 of the shells 200 also rest atop the foundation 103. When installed the shells 200 form a fit with the roof 101 so that no air leakage occurs at the interface between the shells 200 and the roof 101.

The second tubular member 109 is designed to have a height so that when the flange plate 208 is resting the tread surface 125, the second tubular member 109 protrudes above the top surface 122 of the roof 101 so as to prevent precipitation ingress that may collect and flow off the top surface 122 of the enclosure 100. Further protection against the ingress of water from rain or other precipitation into the cavity 203 is further provided by a weather cover 275 (shown in FIG. 12).

Figure 12:
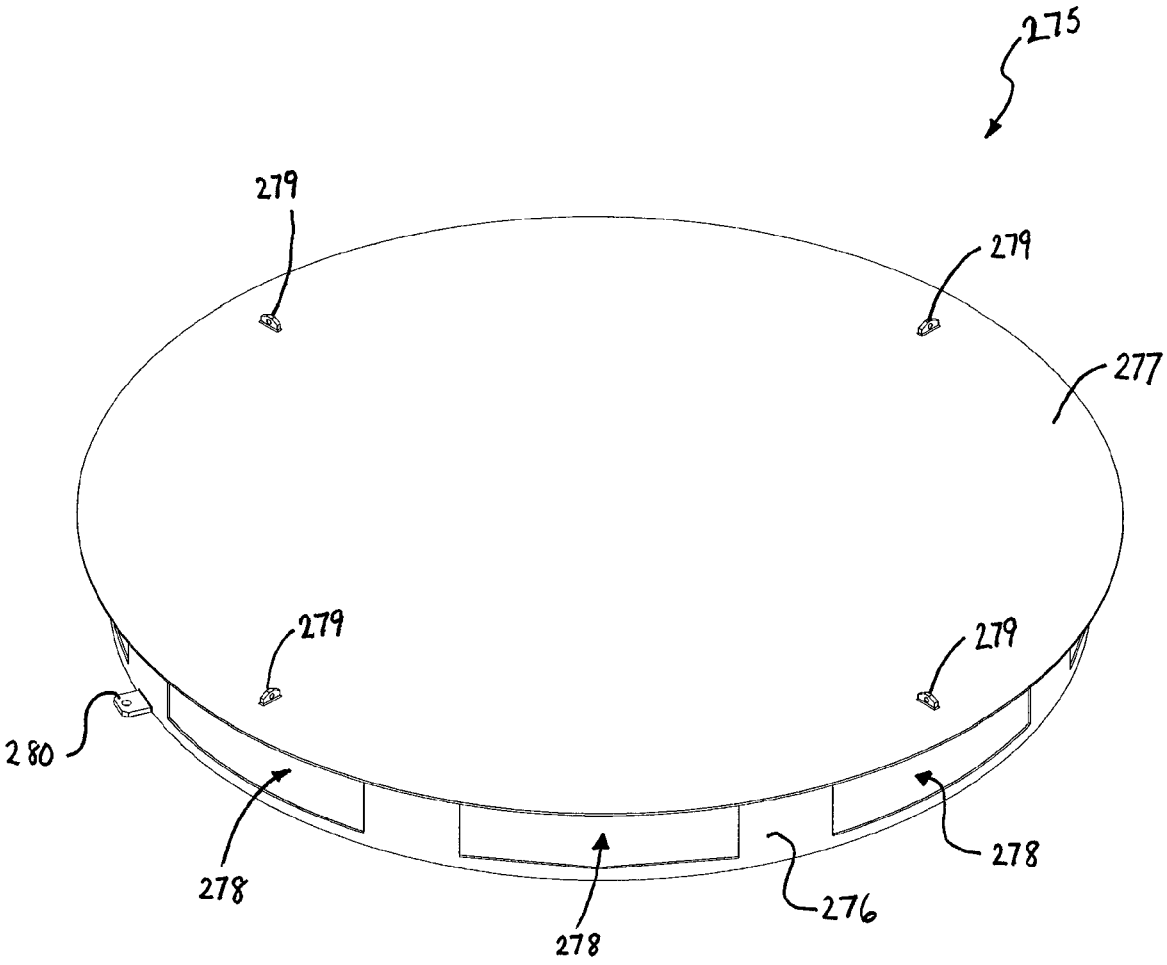
FIG. 12 is a perspective view of a weather cover of the clustered storage system of FIG. 1.

Referring to FIGS. 10 and 12 concurrently, once a container 300 is loaded into the storage shell 200, the lid 250 is positioned atop the brackets 110 as discussed above. Once the lid 250 is in place, the weather cover 275 is positioned over the hole 120 so as to surround the protruding portion of the second tubular member 109. The weather cover 275 comprises a side wall 276 and a sloped roof 277 that overhangs the side wall 276. The side walls 276 comprise a plurality of openings 278 that allow heated air that has escaped through the passageways 211 around the lid 225 to exit the system 1000. The openings 278 have screens for keeping birds and bugs out. The lid also comprises lifting lugs 279 and tie down brackets 180.

Referring back to FIG. 2, once the shells 200 are in place, the shells 200 are fastened to the foundation 103 and the roof slab 101. More specifically, the bottom of the shells 200 are rigidly fastened to the foundation 103 by anchoring the flange portion 113 of the floor plates 112 to the foundation 103 with concrete anchors. Similarly, the top section of the shells 200 are fastened to the roof 101. This fastening can be achieved by anchors protruding from the outside surface of the shell 200. Alternatively, the shells 200 can also be fastened to the roof 101 via collars surrounding the outer surfaces of the shells 200 that act as an upper flange that can either be pressed against a bottom surface of the roof, anchored thereto, or embedded therein. The height of the enclosure 100 is designed to accord with the height of the container stack within the shells 200.

Figure 11:
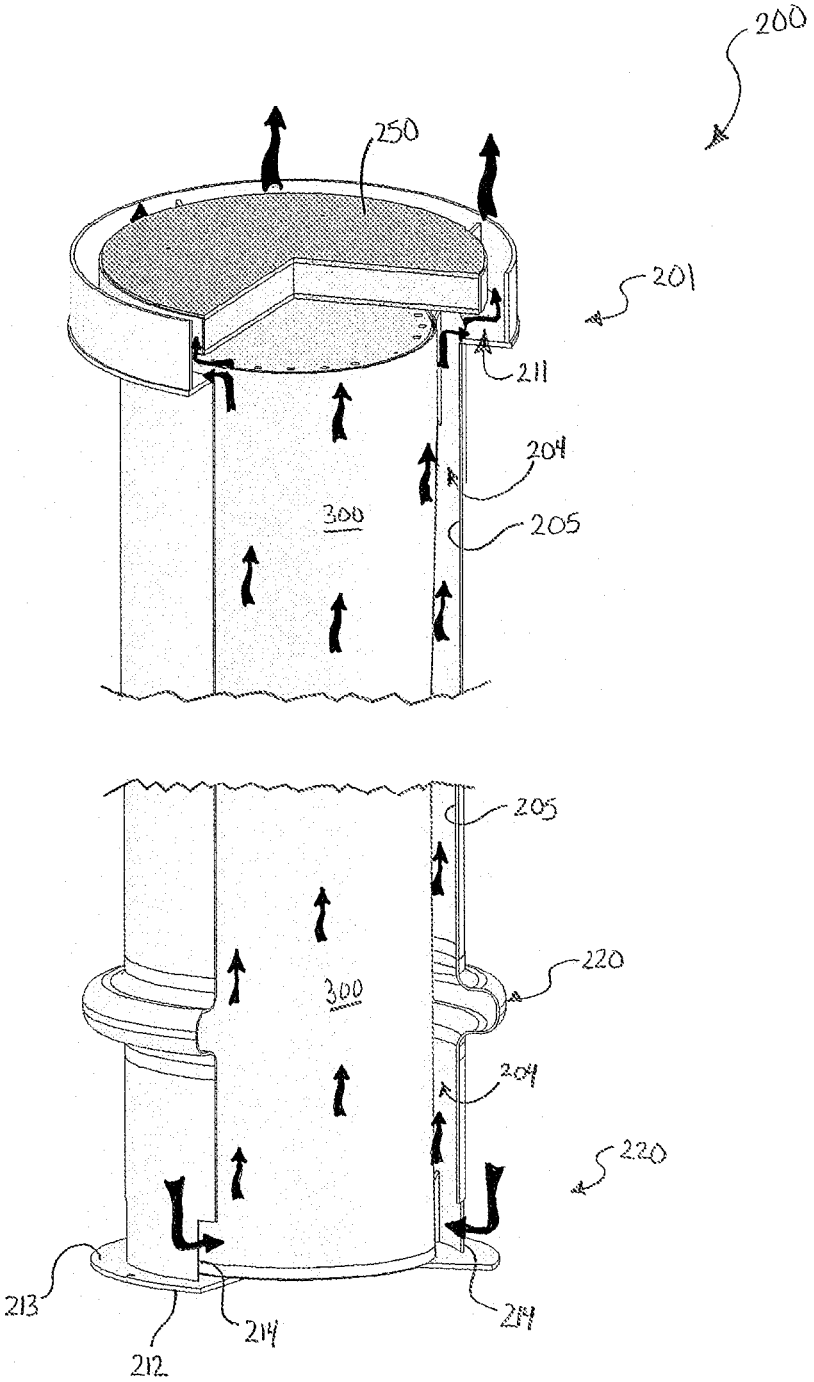
FIG. 11 is a perspective view of the top and bottom sections of one of the storage shells with a transverse section removed and accommodating a multi-purpose canister and schematically illustrating the natural convective air flow about the multi-purpose canister when within the clustered storage system of FIG. 1.

Referring now to FIGS. 1, 3 and 11, a loading procedure and subsequent ventilation of an MPC 300 into the clustered system 1000 will be described. Beginning with FIG. 1, a transfer cask containing a loaded MPC arrives in the container loading area 10 via a rail car or other delivery vehicle. The gantry crane 20 is moved into position above the transfer cask via the rails 31. The lift mechanism 21 is then coupled to the transfer cask and MPC via the yoke and hoist receptively. The transfer cask and MPC 300 are then lifted to a height above thro of 101 of the enclosure by the gantry crane 20. The gantry crane 20 is then translated along the rails 31 to the desired position. If necessary the lifting mechanism 21 is translated along rails 22 until the transfer cask and MPC 300 are in proper alignment axial alignment with the desired hole 120 of the roof slab 101. At this time, the weather cover 275 and lid 250 are removed from that hole 120. A mating device is used to operably connect the transfer cask and the roof 101.

The MPC 300 is then lowered through the hole 120 and into the cavity 203 of the shell 200 until the MPC rests atop the floor plate 212 (or on supports that create a bottom plenum) in a substantially vertical orientation. The MPC 300 is released and the mating device removed. The lid 250 and the weather cover 275 are then installed as described above.

It is preferred that MPCs 300 with low heat and radiation loads be arranged in the perimeter storage shells 200 of the clustered system 1000. In the clustered arrangement, the outer storage shells 200 and their loads provide radiation shielding for the radioactive loads in the inner shells 200.

Referring now to FIGS. 3 and 11 concurrently, once the MPCs 300 are loaded in the shells 200, they give off heat. This heat warms the air in the annular gaps 204. The warmed air within the gaps 204 rise within the gap 204, passes through passageways 211 around the lid 250 and exits the system 100 via the holes 278 in the cover 275. As a result of this chimney effect, additional cool air is drawn from the internal space 110 of the enclosure 100 into bottom of the annular gap 204 via the openings 214. This results in additional cool air being drawn into the internal space 110 of the enclosure 100 via the inlet ducts 106, 107. Cool air within the internal space is free to ventilate around the room as needed. In certain embodiments, additional small holes may be added at strategic locations along the height of the shells to draw air in via the Venturi effect.

Preferably, the enclosure 100 and shells 200 are assembled so that the only way air within the internal space 110 can exit the enclosure is by passing through the shells 200 as described above.

While a number of embodiments of the current invention have been described and illustrated in detail, various alternatives and modifications will become readily apparent to those skilled in the art without departing from the spirit and scope of the invention.

What is claimed is:

1. A system for receiving and storing high level radioactive waste comprising:

a concrete enclosure comprising walls, a roof and a floor that collectively form an internal space;

the roof comprising an array of holes;

an array of metal shells, each metal shell having a cavity for accommodating one or more containers holding high level radioactive waste, the array of metal shells arranged in a substantially vertical and spaced apart manner within the internal space of the enclosure, the array of the metal shells being co-axial with the array of holes of the roof so that containers holding high level radioactive waste can be lowered through the array of holes of the roof and into the cavities of the array of metal shells;

the array of metal shells fastened to the floor and to the roof, the array of metal shells being load bearing columns for the roof;

each of the metal shells comprising: (i) an expansion joint for accommodating thermal expansion and contraction of the metal shells; and (ii) one or more holes at a bottom portion of the metal shell that create a passageway between the internal space and the cavity of the metal shell; and the concrete enclosure comprising one or more inlet ventilations ducts forming passageways from outside of the concrete enclosure to the internal space of the concrete enclosure.

2. The system of claim 1 wherein the internal space circumferentially surrounds each of the metal shells.

3. The system of claim 2 wherein each of the metal shells have a length; and wherein, for each metal shell, the internal space circumferentially surrounds a major portion of the length.

4. The system of claim 1 wherein, for each of the metal shells, the expansion joint is a flanged and flued section of the metal shell.

5. The system of claim 1 wherein, for each metal shell, the expansion, is a collar structure connected to the metal shell.

6. The system of claim 1 wherein, for a major portion of a length of each of the metal shells, a line of sight exists between outer surfaces of adjacent ones of the metal shells.

7. The system of claim 1 wherein the walls of the concrete enclosure are upstanding walls comprising an inner surface and an outer surface; wherein the one or more inlet ventilation ducts are located within upstanding walls; and wherein the one or more inlet ventilation ducts comprise a first inlet ventilation duct that forms a passageway from outside of the concrete enclosure to a top portion of the internal space, and a second inlet ventilation duct that forms a passageway from outside of the concrete enclosure to a bottom portion of the internal space of the concrete enclosure.

8. The system of claim 1 further comprising a gridwork of intersecting beams formed into and protruding from a bottom surface of the roof, the gridwork of beams surrounding the perimeter of each of the holes of the roof.

9. The system of claim 1 wherein, each of the walls, comprises two overlapping and inter-fitted wall structures.

10. The system of claim 1 further comprising:

a plurality of containers holding high level radioactive waste positioned within the cavities of the array of metal shells;

wherein the cavities of the array of the metal shells have a horizontal cross-section that accommodates no more than one of the containers; and wherein for each container positioned in the cavities, an annular gap exists between an outer surface of the container and the inner surface of the metal shell.

11. The system of claim 1 wherein each of the metal shells is fastened to the roof of the concrete enclosure so that a hermetically sealed interface exists between the metal shell and the roof.

12. The system of claim 1 further comprising:

a container receiving area adjacent the concrete enclosure; and a crane system comprising a crane configured to translate between a position above the container receiving area and a position above the concrete enclosure.

13. The system of claim 12 wherein the crane system further comprises: a frame structure extending from the concrete enclosure and into the container receiving area;

rails extending along, the roof of the concrete enclosure and the frame structure; and wherein the crane is operably coupled atop the rails.

14. The system of claim 1 wherein, for each metal shell, the expansion joint is located above the one or more holes of the metal shell and below the roof of the concrete enclosure.

15. The system of claim 1 further comprising;

for each of the metal shells, a first tubular section that forms the cavity, a flange surrounding a top of the first tubular section, and a second tubular section extending upward from an outer edge of the flange;

wherein each of the holes of the roof is formed by a stepped surface having a first riser surface, a tread surface, and a second riser surface; and wherein the array of metal shells extend through the array of holes of the roof so that the flanges of the metal shells rest on the tread surfaces of the array of holes of the roof and the second tubular section protrudes from a top surface of the roof.

16. The system of claim 15 further comprising:

for each of the metal shells, a plurality of circumferentially spaced brackets atop the flange; and for each of the metal shells, a lid positioned atop the plurality of brackets, the plurality of brackets supporting the lid in a spaced relationship from both the flange and the second tubular section so as to create passageways from the cavity to outside of the concrete enclosure.

17. A system for receiving and storing high level radioactive waste comprising:

an enclosure comprising walls having inlet ventilation ducts, a roof comprising an array of holes, and a floor;

an array of metal shells located in an internal space of the enclosure, the array of metal shells being co-axial with the array of holes in the roof so that containers holding high level radioactive waste can be lowered through the array of holes of the roof and into the array of metal shells;

the array of metal shells being load bearing columns for the roof; and each of the metal shells comprising one or more holes at a bottom portion of the metal shell.

18. The system of claim 17 wherein each of the metal shells further comprises an expansion joint for accommodating thermal expansion and/or contraction of the metal shells.

19. The system of claim 17 wherein each of the metal shells have a length;

wherein the internal space is an uninterrupted volume that circumferentially surrounds each of the metal shells for a major portion of the length; and wherein a line of sight exists between outer surfaces of adjacent ones of the metal shells for the major portions of the lengths.

20. A system for receiving and storing high level radioactive waste comprising:

an enclosure comprising; walls, a roof comprising an array of holes, and a floor;

an array of load bearing columns in an internal space of the enclosure that support the roof, each of the load hearing columns comprising:

a metal shell forming a cavity that is aligned with one of the holes of the array of holes so that a container holding high level radioactive waste can be lowered through the one of the holes of the roof into the cavity; and one or more holes at a bottom portion of the metal shell;

the enclosure comprising one or more inlet ventilations ducts forming passageways from outside of the enclosure to the internal space;

for each cavity, one or more outlet passageways extending from a top of the cavity to outside of the concrete enclosure; and for each hole of the roof, a lid covering, the hole of the roof that prevents radiation from escaping via the hole of the roof.

21. The system of claim 1 further comprising, for each cavity, one or more outlet passageways extending from a top of the cavity to outside of the concrete enclosure.

22. The system of claim 21 further comprising, for each hole of the roof, a lid covering the hole of the roof that prevents radiation shine from the hole of the roof.

* * * * *